US005865954A

United States Patent [19]

Laapotti

[11] Patent Number: 5,865,954

[45] Date of Patent: Feb. 2, 1999

[54] METHOD FOR DEWATERING A WEB IN A PAPER MAKING MACHINE EMPLOYING AN EXTENDED NIP PRESS

[75] Inventor: Jorma Laapotti, Jyväskylä, Finland

[73] Assignee: Valmet Corporation, Helsinki, Finland

[21] Appl. No.: 877,989

[22] Filed: Jun. 18, 1997

Related U.S. Application Data

[60] Division of Ser. No. 559,496, Nov. 15, 1995, which is a continuation-in-part of Ser. No. 332,861, Nov. 1, 1994.

[30] Foreign Application Priority Data

| | | | |
|---|---|---|---|
| Dec. 8, 1993 | [FI] | Finland | 935501 |
| Dec. 6, 1994 | [CA] | Canada | 2137432 |
| Dec. 6, 1994 | [EP] | European Pat. Off. | 94 119 255.1 |

[51] Int. Cl.[6] ..... D21F 3/04

[52] U.S. Cl. ..... 162/205; 162/360.3; 162/358.3

[58] Field of Search ..... 162/358.3, 360.2, 162/359.1, 205, 360.3

[56] References Cited

U.S. PATENT DOCUMENTS

| | | | |
|---|---|---|---|
| 2,732,772 | 1/1956 | Hornbostel | 162/360.3 |
| 3,798,121 | 3/1974 | Busker et al. . | |
| 3,861,996 | 1/1975 | Dorfel . | |
| 3,974,026 | 8/1976 | Emson et al. | 162/358.3 |
| 4,059,482 | 11/1977 | Kankaanpaa et al. . | |
| 4,075,056 | 2/1978 | Ely et al. . | |
| 4,086,131 | 4/1978 | Rempel et al. . | |
| 4,201,624 | 5/1980 | Mohr et al. . | |
| 4,257,844 | 3/1981 | Schmitt et al. . | |
| 4,366,025 | 12/1982 | Gordon , Jr. et al. | 162/358.1 |
| 4,440,598 | 4/1984 | Koski et al. . | |
| 4,483,745 | 11/1984 | Wicks et al. . | |
| 4,551,205 | 11/1985 | Laapotti . | |
| 4,561,939 | 12/1985 | Justus . | |
| 4,662,992 | 5/1987 | Mirsberger . | |
| 4,704,192 | 11/1987 | Cronin . | |
| 4,889,598 | 12/1989 | Niskanen . | |
| 4,923,570 | 5/1990 | Steiner et al. . | |
| 5,108,547 | 4/1992 | Pajula . | |
| 5,120,399 | 6/1992 | Filzen . | |
| 5,178,732 | 1/1993 | Steiner et al. . | |
| 5,240,563 | 8/1993 | Karvinen et al. . | |
| 5,389,205 | 2/1995 | Pajula et al. . | |
| 5,468,349 | 11/1995 | Schiel . | |

FOREIGN PATENT DOCUMENTS

| | | |
|---|---|---|
| 1315578 | 4/1993 | Canada . |
| 0 289 477 A2 | 11/1988 | European Pat. Off. . |
| 0 359 696 | 3/1990 | European Pat. Off. . |
| 0 549 553 A1 | 6/1993 | European Pat. Off. . |

(List continued on next page.)

OTHER PUBLICATIONS

*Wochenblatt für Papierfabrikation 19 (1993),* pp. 780–782 "Die Flexonip®–Pressen".

*Primary Examiner*—Karen M. Hastings
*Attorney, Agent, or Firm*—Cohen, Pontani, Lieberman & Pavane

[57] ABSTRACT

A Method for dewatering a paper web (W) formed in a preceding forming section of a paper making machine in which dewatering felts (11, 28) are applied to both surfaces of the paper web (W) as the paper web (W) travels in a closed draw from the forming section through a first extended nip press ($NP_1$), thereby drawing a substantial amount of water simultaneously and symmetrically from both surfaces of the paper web (W). The upper felt (11) transports the paper web (W) from the first extended nip ($NP_1$) to a smooth surfaced center roll (30) where the paper web (W) passes through at least one roll nip ($N_1$, $N_2$) or extended nip ($NP_2'$, $NP_3'$). The center roll (30) is positioned at an elevation higher than the first extended nip ($NP_1$) thereby reducing the length of the press section. In a second roll nip ($N_2$), a press fabric (33) is substituted for the upper felt (11) to efficiently remove additional water. Additional extended or roll nips ($NP_2$, $N_3$, $N_0$, $N_E$) may be interposed between the center roll (30) and the succeeding drying section, between the forming section and the first extended nip ($NP_1$), or between the first extended nip ($NP_1$) and the center roll (30).

7 Claims, 10 Drawing Sheets

FOREIGN PATENT DOCUMENTS

| | | |
|---|---|---|
| 75382 | 2/1984 | Finland . |
| 75890 | 1/1987 | Finland . |
| 885768 | 12/1988 | Finland . |
| 890530 | 9/1989 | Finland . |
| 84377 | 12/1989 | Finland . |
| 905798 | 11/1990 | Finland . |
| 913886 | 2/1992 | Finland . |
| 924754 | 10/1992 | Finland . |
| 925634 | 12/1992 | Finland . |
| 88 05 966.9 | 10/1989 | Germany . |
| 92 06 340.3 | 9/1992 | Germany . |
| 43 21 399 A | 11/1993 | Germany . |
| 43 21 399 A1 | 11/1993 | Germany . |
| 43 21 404 A1 | 11/1993 | Germany . |
| 43 21 403 A1 | 1/1994 | Germany . |
| 43 21 404 C2 | 1/1994 | Germany . |
| WO 88/06205 | 8/1988 | WIPO . |
| WO 92/16689 | 10/1992 | WIPO . |
| WO 92/20859 | 11/1992 | WIPO . |
| WO 93 12289 A | 6/1993 | WIPO . |
| WO 93/12289 | 6/1993 | WIPO . |

W
P
12a
10
12
D1
11
H1
29
28
13'
13
D2
NP1
22
21
D3
20
L1
14a
15'
15
D4
70
11
14b
N1 (NP2')
N2 (NP3')
30
31
29a
D5
W0
37
D7
36
33
34
D4
32
32'
80
33
34
D6
35
37a
38
D9
40
39'
39
D8
W
NP2 (N3)
42
41
54
D10
50
W
53
51a
51b
52
53

METHOD FOR DEWATERING A WEB IN A PAPER MAKING MACHINE EMPLOYING AN EXTENDED NIP PRESS

CROSS REFERENCE TO RELATED APPLICATION

This is a division of application Ser. No. 08/559,496 filed Nov. 15, 1995, which is a continuation-in-part of application Ser. No. 08/332,861 filed Nov. 1, 1994.

FIELD OF THE INVENTION

The present invention relates to a press section and a method of a paper making machine in which water is removed from a paper web formed in a preceding forming section by the application of mechanical pressure to the paper web.

BACKGROUND OF THE INVENTION

It is known from the prior art to use one or more extended-nip presses in a press section that follows the forming section of a paper machine. In such an extended-nip press, the length of the pressing zone extending in the running direction of the paper web is substantially longer than that encountered in a roll press nip. Traditionally, extended-nip presses were commonly used only in paperboard machines and to make thicker grades of paper. However, more recently, extended-nip presses have also been introduced for use in the production of thinner paper grades, such as newspaper and fine papers.

Known press sections have various problems, especially when used in the high speed manufacture of relatively thin paper products. Relatively thin paper products are much more likely to be damaged during their manufacture than are thicker paper products, especially at relatively high web speeds of about 25 to about 35 m/sec. The relatively low number of intertwined fibers due to the very thinness of such thin paper products is one cause of such vulnerability. This latter factor also contributes to the difficulties encountered when attempting to separate such relatively thin paper stock from relatively smooth surfaces because considerable adhesion forces have to be overcome. Consequently, the incidence of tearing of and other damage to relatively thin paper webs is much higher even in such currently available press sections that employ extended nip presses than that encountered with thicker materials.

Examples of prior art that is considered to be most closely related to the present invention can be found in the following published patent documents: Finnish patent application No. 890530 (corresponding to U.S. Pat. No. 4,923,570 and published German patent document No. DE-OS 3808293.4), German utility model No. DE-GBM 8805966, Finnish patent application No. 913886 (corresponding to U.S. Pat. No. 5,178,732 and published German patent document No. DE-OS 4026021), Finnish patent No. 75,382, Finnish patent application No. 811403 (corresponding to U.S. Pat. No. 4,440,598), and U.S. Pat. Nos. 4,257,844, 4,551,205, 4,704,192, and 5,120,399. Further, reference is made to the paper in the journal *Wochenblatt für Papierfabrikation* 19 (1993), pages 780 to 782 "Die Flexonip®-Pressen", which describes some of the latest extended nip press constructions of J. M. Voith GmbH. The press sections in these prior art devices have various problems.

In Finnish patent application No. 890,530, especially with reference to FIGS. 3 and 4 (and in the corresponding U.S. Pat. No. 4,923,570), the paper web is transferred from one extended nip press into a second and/or third extended nip press on the smooth surface of a gliding belt mantle of the extended nip press. Because the gliding belt mantle is smooth, water is pressed out of the paper web only through the surface of the paper web which faces away from the mantle because the smooth surface of the mantle has no route by which water can leave the paper web. Additionally, such a smooth surface mantle has pronounced adhesion properties and therefore poor paper web transfer properties. Moreover, the first nip is not an extended nip that removes water efficiently through both surfaces of the paper web, and the overall concept disclosed is not that of a compact press section of several nips.

In the FIGS. 1 and 2 embodiments in German utility model No. DE-GMB 88 05 966, the press section consists solely of two separate extended-nip presses in which the high load pressing is carried out on the same face of the same pressing felt. Moreover, the paper web is transferred over the long distance between the two nips by confining the paper web between two wet felts and on the face of one felt, thus resulting in the rewetting of the web by water previously expelled from the paper web to the felt. Consequently, the water content of the paper web increases after it is pressed in this so-called rewetting process. While the geometries of the press sections that are shown in FIGS. 3, 5 and 6 are more compact than those of FIGS. 1 and 2, the same press felt runs through both of the extended nips, thereby reducing the water absorbing capacity of the felt in the second extended nip. The transfer of the paper web from one extended nip to the other relies fully on the differences in the surface characteristics of the pressing felts as there is no additional mechanism to ensure the transfer of the paper web.

In Finnish patent application No. 913886 (corresponding to U.S. Pat. No. 5,178,732), FIGS. 1, 1*a*, 2, 3, 3*a* and 3*b*, a transfer means, which has a dewatering capacity lower than that of a felt, runs through all the press nips. Since the largest amount of water is removed in the first nip, the dewatering in one direction (i.e. through one surface of the paper web) is limited by the transfer means contacting that surface. In FIGS. 2, 2*a*, 3, 3*a* and 3*b*, the transfer means in the first nip consists of a gliding belt which is impervious to water and smooth so that dewatering through one surface of the paper web is completely precluded.

Finnish patent application No. 811403 (corresponding to U.S. Pat. No. 4,440,598), Finnish patent No. 75,382, and U.S. Pat. No. 4,257,844 do not disclose or suggest the use of an extended nip press with a high dewatering capacity at the first nip or anywhere else, or a closed web transfer to the dryer section.

U.S. Pat. No. 5,120,399 merely discloses the use of a single felt extended nip at the first nip. In this case, water is removed from the paper web in one direction only. Also, the press sections comprise only two nips, and no compact multi-nip press section is suggested.

SUMMARY OF THE INVENTION

The present invention involves a press section of a paper making machine for dewatering a paper web formed in a preceding forming section. In the method of the present invention, a pick-up felt is used to remove the paper web from the forming wire that transports the paper web through the forming section of the paper making machine. The pick-up felt is applied to the upper surface of the paper web and then a lower felt is applied to the lower surface of the paper web. The two felts are comprised of a fabric material which are preferably slightly heavier and thicker than normal so that the felts absorb a substantial amount of water from the paper web. The two felts may also or instead be water permeable. The paper web, sandwiched between the two felts, passes through a first press nip which is an extended nip in that the paper web is pressed along its width and, in particular, along a portion of the length of the paper web, i.e., in the direction of travel or running direction of the web, rather than along a line of contact as in a conventional press nip. In the first extended nip, water is pressed from the upper surface of the paper web and is absorbed by the pick-up felt, and water is pressed from the lower surface of the paper web and is absorbed by the lower felt. Thus, in the first extended nip, water is simultaneously and symmetrically removed from both the upper and lower surfaces of the paper web along an extended length of the paper web. Consequently, good symmetry of the structure of the paper web through its thickness is obtained also resulting in symmetry of the density and porosity of both surfaces of the paper web. In this first press nip of the press section, relatively high pressures (about 100 to about 1,400 kN/m) can be applied to the paper web because it is sandwiched between the two felts. As a result, a substantial amount of water can be removed from the paper web in the first extended nip, thereby increasing its dry solids content and its strength and reducing the possibility that the paper web will break or otherwise be damaged when being transferred from one felt to another, when being transported between press nips, or when being removed from a felt or roll, even at relatively high web speeds of about 25 to about 35 m/sec.

After the lower felt is separated from the paper web, the paper web, supported by the pick-up felt, travels to a first roll nip where a center roll with a smooth surface directly contacts the paper web and additional water is pressed from the paper web into the pick-up felt. Alternatively, this first roll nip may be an extended nip and may be formed on one of the rolls forming the first extended nip or on a separate roll.

A roll nip may also be positioned between the first extended nip and the first roll nip formed on the center roll so that the paper web, sandwiched between the pick-up felt and the lower felt passes through this roll nip before the lower felt is separated from the paper web.

Downstream of the first roll nip, the pick-up felt is separated from the paper web and a press felt is applied to the upper surface of the paper web that was previously in contact with the pick-up felt. The paper web, supported on its upper surface by the press felt and on its lower surface by the center roll, then passes through a second roll nip where additional water is removed from the paper web to be absorbed by the press felt which is also comprised of a fabric material that absorbs water. The second roll nip may alternatively be replaced by an extended nip.

Downstream of the second roll nip, the press felt is removed, leaving the paper web on the smooth surface of the center roll. The paper web is then transferred in a short open draw to the lower surface of a drying wire and then to the first drying or lead-in cylinder of the following dryer section of the paper making machine. Means, such as for example a transfer band loop, may be employed to assist in such transfer.

From the point that the paper web enters the press section of the present invention through the first extended nip, the first roll nip and the second roll nip, the paper web is always supported and there are no open draws, thereby providing reliable transfers of the paper web from the forming section of the paper making machine through these three press nips.

The center roll (and thus the first and second roll nips which employ the center roll) is elevated relative to the first extended nip so that the paper web changes its direction of travel by a substantial degree, i.e., by no less than about 45°. A means is provided for altering the course of travel of the paper web without an open draw between the first extended nip and the first roll nip. Because a substantial amount of water is removed from the paper web at the first extended web, thereby significantly increasing its dry solids content, the paper web has sufficient structural strength upon leaving the first extended nip that the running direction of the paper web can be changed significantly without risking a break in the paper web, even to the extent that the paper web travels substantially vertically when supported by a felt. Consequently, by positioning the center roll and its two roll nips at a higher elevation than the extended nip, rather than on substantially the same level, a compact press section results which occupies a sufficiently small amount of space in the longitudinal direction of the machine (i.e., in the direction of travel of the paper web) so that it can substitute for existing press sections during the rebuilding, upgrading or modernization of an existing paper making machine to increase its dewatering capacity and running speed. The press section of the present invention can easily fit into the space occupied by the existing paper making machinery consisting of only roll nips such as the Sym-Press II® press made by Valmet Corporation.

The first extended nip is preferably comprised of two rolls: a hose roll with a flexible mantle and a press roll with a rigid, solid mantle with a hollow face, such as a grooved face, for example. In the interior of the flexible mantle of the hose roll proximate the point where the flexible mantle is closest to the press roll is a press or loading shoe. The press shoe and the flexible mantle apply pressure to the lower felt and the paper web W in the first extended nip throughout the area or zone of the extended nip, both in the direction of progress or advance of the paper web and in a direction transverse to the direction of progress the paper web. The hose roll and the press roll are stacked one above the other with either roll being in the upper position.

Steam boxes or other means to heat the paper web are preferably positioned in the press section of the present invention along the route of travel of the paper web to further increase the amount of water that is removed from the paper web in the press section. Additionally, vacuum boxes and suction zones in various rolls are preferably strategically positioned to ensure reliable transfer of the paper web between the various felts and rolls.

The method of the present invention is particularly suited for manufacturing printing paper grades, such as newspaper or newsprint, SC-paper, LWC base paper, and fine paper. Additionally, the method of this present invention can also be used for manufacturing paperboard, such as liner board or corrugated medium.

In an alternative embodiment of the method of the present invention for use, for example, in the production of thicker paper grades or for operating the press section at above-average paper web running speeds, a second extended nip is interposed between the second roll nip and the drying section (which of course is downstream of the press section) to remove further water from the paper web before the paper web enters the drying section of the paper making machine. At this second extended nip, a lower felt can be applied to the lower surface of the paper web to aid in dewatering the paper web. When such a lower press felt is used, water is removed from the paper web in the second extended nip through the opposite surface (i.e., the lower surface) of the paper web that water was removed through the first and second roll nips (i.e., the upper surface), thereby further contributing to the symmetry of the structure of the paper web through its thickness. The second extended nip has a construction that is similar to that of the first extended nip. Additionally, an upper press felt can be applied to the upper surface of the paper web as the paper web passes through the second extended nip. Alternatively, instead of the second extended nip, another roll nip may be substituted.

In an alternative embodiment, the upper roll of the first extended nip may also constitute one of the rolls of the first roll nip. Furthermore, more than two roll nips may be situated around the center roll.

As previously noted, to further ensure that the paper web separates from the center roll intact, a transfer band loop may encircle the center roll so that the paper web does not contact the center roll. The transfer band loop is preferably made of fabric and the surface thereof that contacts the paper web is preferably smooth. The transfer band loop may also extend through the second extended nip if it is also included in the press section, and to the drying wire that leads to first drying or lead-in cylinder of the following dryer section of the paper making machine so that there are no open draws in the entire press section.

In another embodiment of the present invention, a primary roll or extended nip is used to remove water from the paper web while the paper web is still supported by the forming wire that transfers the paper web from the forming section to the press section. A press felt is applied to the upper surface of the paper web before the paper web supported on its lower surface by the forming wire enters this primary roll or extended nip. Because of the high water content of the paper web at this point, the press felt is preferably a relatively water permeable and open fabric that also absorbs water. The primary press nip is particularly useful in the manufacture of paperboard or other paper that is thicker than average, in paper making machines employing pulp grades which are relatively difficult to dewater, or in paper making machines where the desired paper web running speed is very high.

Other objects and features of the present invention will become apparent from the following detailed description considered in conjunction with the accompanying drawings. It is to be understood, however, that the drawings are intended solely for purposes of illustration and not as a definition of the limits of the invention, for which reference should be made to the appended claims.

BRIEF DESCRIPTION OF THE DRAWINGS

In the drawings, wherein like reference numerals delineate similar elements throughout the several views.

DETAILED DESCRIPTION OF THE PREFERRED EMBODIMENTS

Figure 1:
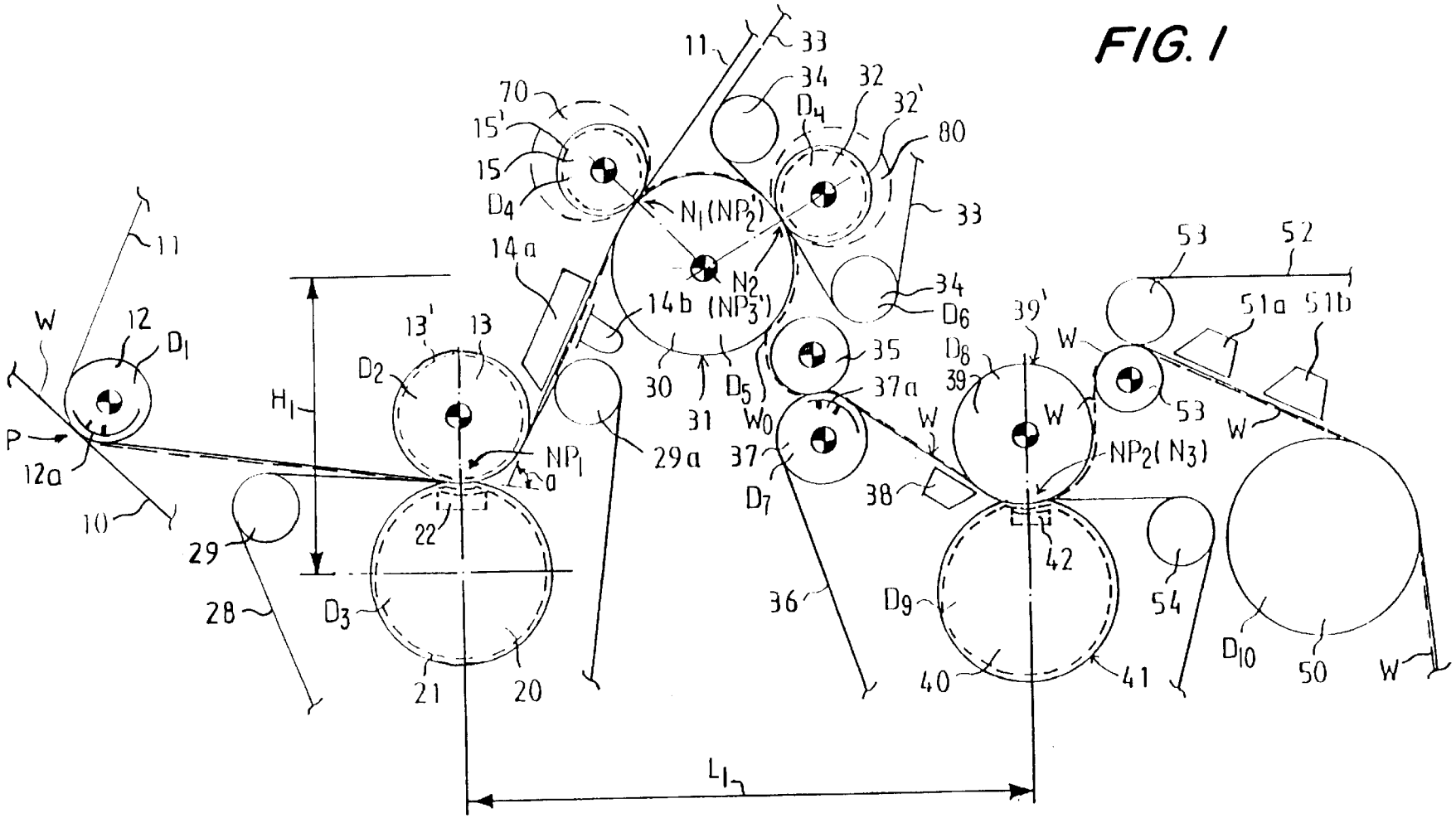
FIG. 1 is a diagrammatic side elevational view of a first embodiment of the press section of a paper machine of the present invention.

Referring to a first embodiment of a press section employing a method of the present invention shown in FIG. 1, the paper web W enters the press section on a forming wire 10 after being formed in the forming section of the paper machine. At this point, the paper web W includes a substantial amount of water. In the press section, much of the water in the paper web W is removed before the paper web W enters a subsequent drying section of the paper machine for additional dewatering, principally by the application of heat. The paper web W is separated from the forming wire 10 and transferred to the press section at a pick-up point P by a pick-up felt 11 which is preferably aided by the vacuum action of a suction zone 12*a* of a pick-up suction roll 12. The pick-up suction roll is preferably driven and preferably has a diameter $D_1$ of about 1,100 mm., although suction rolls of a wide range of diameters may be employed. The pick-up felt 11 which contacts the upper surface of the paper web W acts as a water-receiving fabric to remove water from the paper web W through the upper surface of the paper web W.

The paper web W, supported on its upper surface by the pick-up felt 11, is then transported to the first extended nip ($NP_1$ which is formed between press roll 13 and hose roll 20. At the first extended nip ($NP_1$, a lower felt 28, which is guided by a guide roll 29, contacts and supports the lower surface of the paper web W, and all three components (lower felt 28, paper web W and pick-up felt 11) pass between press roll 13 and hose roll 20. Like pick-up felt 11, lower felt 28, which contacts the lower surface of the paper web W, acts as a water-receiving fabric to remove water from the paper web W through its lower surface.

The hose roll 20 is provided with a flexible mantle 21. The flexible mantle 21 is preferably hollow-faced, such as grooved, blind-drilled, or provided with other recesses to provide either a flow path for the expressed water or small receptacles for the water as it is squeezed from the paper web W. In the interior of the flexible mantle 21, proximate the point $NP_1$ where the flexible mantle 21 of the hose roll 20 is closest to the press roll 13, is a press or loading shoe 22, which is loaded by hydraulic cylinders (not shown). These hydraulic cylinders are used to adjust the level and distribution of the compression pressure applied by the press shoe 22 and the flexible mantle 21 to the lower felt 28 and the paper web W in the first extended nip $NP_1$, both in the direction of progress or advance of the paper web W and in a direction transverse to the direction of progress the paper web W. The hose roll 20 is a known press component that is disclosed, for example, in Finnish patent application No. 905798 (published), especially FIGS. 10, 11, and 12, and corresponding U.S. patent application Ser. Nos. 07/795,043 and 08/026,851, all three of which are incorporated herein by reference. The diameter $D_3$ of the hose roll 20 is preferably about 1,800 mm., although this typical dimension is not critical.

Figure 5:
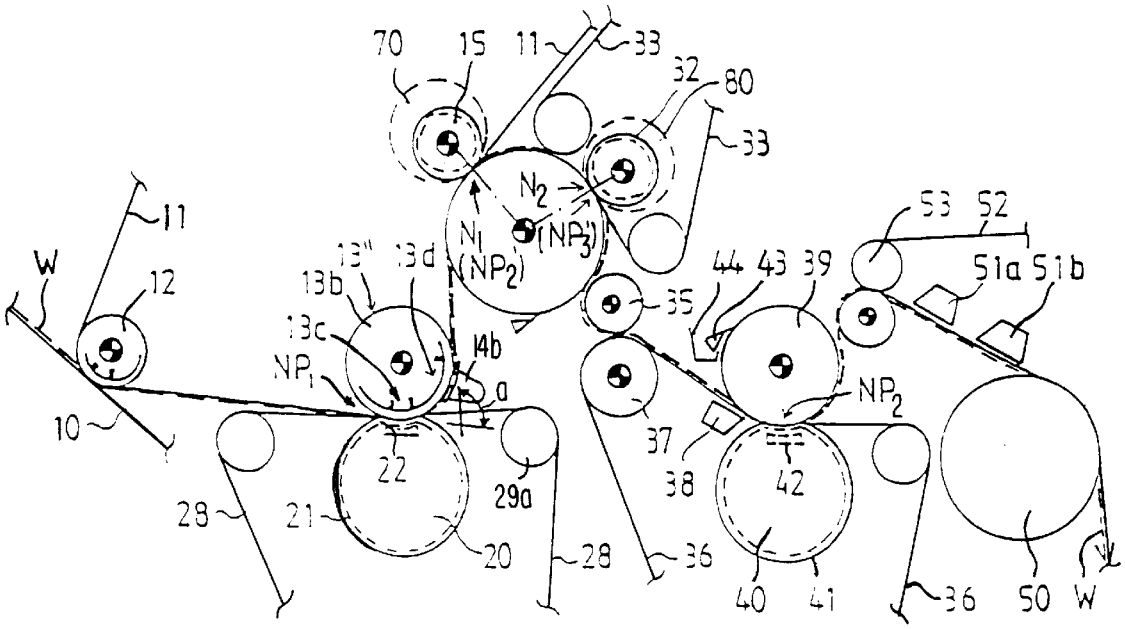
FIG. 5 is a diagrammatic side elevational view of a fifth embodiment of the press section of the present invention.

The press roll 13 has a rigid, solid mantle with a hollow face 13', as by grooving, for example. The solid mantle preferably has a variable-crown for machines wider than about 3 m., as is known in the art. The press roll 13 is preferably a driven roller and preferably has a diameter $D_2$ of about 1,250 nmm., although this dimension is not critical to the present invention. In view of the high compressive force applied to the press roll 13 at the first extended nip $NP_1$ (up to about 1,400 kN/m), it is preferable that the press roll 13 have a solid mantle rather than a perforated mantle as employed in suction rolls, which may also be used (as shown in FIG. 5 and discussed in detail below) because a perforated suction-roll mantle typically has a maximum load of only about 150 kN/m.

Thus, at the first extended nip $NP_1$ the paper web W is pressed by the compression force applied by the press shoe 22 along the width of the paper web W (i.e., transverse to the direction of travel of the paper web W) and also along a length of the paper web W (i.e., in the direction of travel of the web). Additionally, water pressed from the paper web W at the first extended nip $NP_1$ leaves the paper web W through its upper surface to be absorbed by or passed through the pick-up felt 11 and though its lower surface to be absorbed by or passed through lower felt 28. Water passing through the two felts 11, 28 will flow away from the first extended nip ($NP_1$ through the grooved surfaces preferably provided in the flexible mantle 21 of the hose roll 20 and in the solid mantle 13' of the press roll 13, as already mentioned. The linear load at the first extended nip $NP_1$ is preferably from about 100 to about 1,400 kN/m, most preferably between about 200 and 800 kN/m. The length of the first extended nip $NP_1$ in the running direction of the paper web W is between about 100 and about 300 mm.

It is preferable that the pick-up felt 11 and the lower felt 28 are slightly heavier and thicker than normal because the amount of water that is removed in the first extended nip $NP_1$ is great and the high pressing force applied in the first extended nip ($NP_1$ tends to cause the paper web W to become marked by the fabric comprising the felts 11 and 28 or by the hollow, e.g., grooved, face in the press roll 13 or the hose roll 20.

Even when the paper web W is run through the first extended nip $NP_1$ at relatively high running speeds (from about 25 m/sec. to about 35 m/sec.), the paper web W nevertheless has a sufficiently long dwell time in the first extended nip $NP_1$ so that efficient dewatering of the paper web W occurs. Moreover, this dewatering is two-sided and symmetrical. Thus, the dry solids content of the paper web W immediately upstream of the first extended nip $NP_1$ is typically in a range of about 12% to about 20%, while immediately downstream of the first extended nip $NP_1$ the dry solids content of the paper web W may be increased to as much as 30% or 40%.

Downstream of the first extended nip $NP_1$, the lower felt 28 passes over another guide roll 29*a* which is positioned above and downstream of the first extended nip $NP_1$. Between the first extended nip $NP_1$ and the guide roll 29*a*, the pick-up felt 11 and the lower felt 28, with the paper web W sandwiched in between, wrap partially around the press roll 13 and change direction by an angle a relative to the horizontal plane in which the paper web W entered the first extended nip $NP_1$. Thus, the paper web W and the two felts 11, 28 travel in an upwardly inclined direction immediately downstream of the first extended nip $NP_1$. The change in the running or advancement direction of the upper felt 11 and of the paper web W by the angle a contributes to reducing the amount of space required for the press section of the present invention because the paper web W changes from a substantially horizontal running direction to a substantially vertical running direction. The angle a is preferably greater than about 45°, and in FIG. 1 is shown as about 70°.

At guide roll 29*a*, the lower felt 28 separates from the paper web W and the pick-up felt 11 and passes initially around a guide roll 29*a* and ultimately back to the guide roll 29 after being at least partially dried by means not shown. The position of the guide roll 29*a* above and downstream of the first extended nip $NP_1$, helps to ensure that the paper web W follows and remains adhered to the pick-up felt 11. To further ensure that the paper web W follows the pick-up felt 11 as the lower felt 28 passes around the guide roller 29*a*, a suction box 14*a* is positioned within the loop of the pick-up felt 11 proximate the guide roll 29 to cause the paper web W to be drawn upward to the surface of the pick-up felt 11. A steam box 14*b*, which may alternatively be an infrared radiator or other means to heat the paper web W, may be positioned proximate the exposed unsupported lower surface of the paper web W substantially opposite to the suction box 14*a* as shown in FIG. 1 to heat the paper web W directly thereby aiding in removing water from the paper web W.

After passing between the suction box 14*a* and the steam box 14*b*, the paper web W, supported on its upper surface by the pick-up felt 11, passes around a center roll 30 which has a smooth face or mantle 31 and is preferably a driven roller. The center roll 30, which is preferably formed of metal or stone, may be heated by, for example, circulating hot water through bores in the roll mantle 31, as disclosed in detail in Finnish patent applications Nos. 925,634 (published) and 924,754 (published), corresponding to U.S. patent application Ser. No. 17,745, all three of which are incorporated herein by reference. The center of the center roll 30 is typically positioned at a height $H_1$ of about 1,900 to about 2,900 mm above the center of the hose roll 20.

A press roll 15, which is preferably a driven roll, contacts the upper surface of the pick-up felt 11 and presses the paper web W between the pick-up felt 11 and the center roll 30 to form a first roll nip $N_1$, thereby further dewatering the paper web W. The center roll 30 preferably has a diameter $D_5$ of about 1,600 mm. The length of the first roll nip $N_1$ in the running direction of the paper web W is about 10 mm to about 30 mm, or about one tenth that of the length of the first extended nip $NP_1$.

The press roll 15 is a solid mantle roll, preferably with a variable-crown which has a hollow face 15', as by grooving, for example. The press roll 15 is preferably a driven roller and preferably has a diameter $D_4$ of about 1,000 mm. In view of the high compressive force applied to the press roll 15 at the first roll nip $N_1$, typically between about 50 and about 150 kN/m and preferably between about 70 and about 130 kN/m, it is preferable that the press roll 15 have a solid mantle rather than a perforated suction-roll mantle, which, however, may also be used.

Although in FIG. 1, a first roll nip $N_1$ is shown, alternatively a second extended nip $NP_2'$ may be used instead of the first roll nip $N_1$. In this configuration, the press roll 15 is replaced by a hose roll 70 (shown in FIG. 1 in dashed lines) having a flexible mantle and a press shoe so that the hose roll 70 is similar to hose roll 20. Using the hose roll 70 rather than the press roll 15 is preferred when thicker paper grades or board is being made.

After emerging from the first roll nip $N_1$, the paper web W adheres to and follows the smooth face 31 of the center roll 30 and is thus separated from the pick-up felt 11. The pick-up felt 11 ultimately returns to the pick-up suction roll 12 after preferably being at least partially dried by known means, not shown.

A press felt 33, guided by a guide roll 34 is applied to the upper (e.g., outer) surface of the paper web W in a second roll nip $N_2$ which is formed between the center roll 30 and a press roll 32. The length of the second roll nip $N_2$ in the running direction of the paper web W is about 10 mm to about 30 mm, or about one tenth that of the length of the first extended nip $NP_1$. Like press roll 15, the press roll 32 is also a solid mantle roll, preferably with a variable-crown which has a hollow, e.g., grooved, face 32' for example to provide a path for water picked up by the press felt 33 in excess of its water holding capacity. The press roll 32 is preferably a driven roller and preferably has a diameter $D_4$ of about 1,000 mm. In view of the high compressive force applied to the press roll 15 at the second roll nip $N_2$, typically between about 70 and about 200 kN/m, preferably between about 90 and about 150 kN/m, and preferably greater than the compressive force in the first roll nip $N_1$, it is preferable that the press roll 32 have a solid mantle rather than a perforated suction-roll mantle, which may also be used.

Although in FIG. 1, a second roll nip $N_2$ is shown, alternatively another extended nip $NP_3$' may be used instead of the second roll nip $N_2$. In this configuration, the press roll 32 is replaced by a hose roll 80 (shown in FIG. 1 in dashed lines) having a flexible mantle and a press shoe so that the hose roll 80 is similar to hose roll 20. Using the hose roll 80 rather than the press roll 32 is preferred when thicker paper grades or board is being made. Either press roll 15 or press roll 32 may be replaced by extended nip hose rolls 70, 80, or both may be replaced with extended nip hose rolls. However, if an extended nip is to be used in connection with the center roll 30, it is preferable that the first nip is a roll nip $N_1$ employing a press roll 15 and the second nip is an extended nip $NP_3$' employing a hose roll 80.

After passing through the second roll nip $N_2$ along with the paper web W, the press felt 33 is removed from the paper web W, which adheres to the smooth surface of the center roll 30, by another guide roll 34 which preferably has a diameter $D_6$ of about 700 mm. The press felt 33 then travels back to the first guide roll 34 after being at least partially dried by means (not shown) forming no part of the present invention but which are known in the art.

To obtain a favorable distribution of the nip loads on the center roll 30, the first and second roll nips $N_1$ and $N_2$ are formed at successive upper quadrants on the upper half of the center roll 30.

The paper web W is separated from the smooth face 31 of the center roll 30 and is transferred by a guide roll 35, which is preferably driven, in short open draw $W_0$. Means (not shown) known in the art may be included to assist in the transfer of the paper web W, such as the transfer band loop 60, 60*b* shown in FIGS. 6 and 7 which are discussed in detail below or making guide roll 35 a suction roll. Additionally or alternatively, the paper web W may be initially threaded as known in the art so that it follows the desired path. From guide roll 35, 10. the paper web W is then transferred to a lower felt 36 which travels around a transfer suction roll 37 which is preferably driven. The lower felt 36 acts in the second extended nip $NP_2$, discussed below, as a water-receiving fabric to remove water from the paper web W through the lower surface of the paper web W. Thus, water is removed from the paper web W in the second extended nip $NP_2$ through the opposite surface (i.e., the lower surface) of the paper web that water was removed in the first and second roll nips $N_1$ and $N_2$ (i.e., the upper surface), thereby further contributing to the symmetry of the structure of the paper web W through its thickness.

The transfer of the paper web W to the transfer suction roll 37 is preferably aided by the vacuum action of a suction zone 37*a* in the transfer suction roll 37. The transfer suction roll 37 preferably has a diameter $D_7$ of about 1,100 mm., although this dimension is not critical. To further ensure that the paper web W adheres to the lower felt 36, a suction box 38 or similar device may be positioned within the loop of the lower felt 11 as shown to cause the paper web W to be drawn downward and held to the surface of the lower felt 11.

The second extended nip $NP_2$ is formed by a press roll 39, which is preferably driven, and a lower hose roll 40. The lower hose roll 40, like the hose roll 20, has a flexible mantle 41 and a press or loading shoe 42. The flexible mantle 41 is preferably hollow-faced, such as grooved, blind-drilled, or provided with other recesses to remove water expressed through the lower felt 36 at the second extended nip $NP_2$. The press shoe 42 is similarly loaded by hydraulic cylinders (not shown) which adjust the level and distribution of the compression pressure applied by the press shoe 42 and the flexible mantle 41 to the lower felt 36 and the paper web W in the second extended nip $NP_2$, both in the direction of progress or advance of the paper web W and in a direction transverse to the direction of progress the paper web W. The lower hose roll 40 preferably has a diameter $D_9$ of about 1,800 mm. Again, such dimension is typical and not critical.

The press roll 39 is a solid mantle roll, preferably with a variable-crown and a smooth face 39' and preferably has a diameter $D_8$ of about 1,250 mm. The press roll 39 may be heated, for example, by circulating hot water through bores in the roll mantle, as disclosed in detail in Finnish patent applications Nos. 925,634 (published) and 924,754 (published), corresponding to U.S. patent application Ser. No. 17,745, all previously incorporated herein by reference.

In the second extended nip $NP_2$, water is pressed out of the paper web W partly absorbed by and partly expressed through the lower felt 36. The linear load at the second extended nip $NP_2$ is preferably from about 150 to about 1,400 kN/m, most preferably between about 400 and 1,200 kN/m. The length of the second extended nip $NP_2$ in the running direction of the paper web W is between about 100 and about 300 mm. The horizontal distance $L_1$ between the center of hose roll 20 and the center of the lower hose roll 40 is from about 3,200 to about 7,200 mm.

It is preferable that the lower felt 36 is slightly heavier and thicker than normal because the amount of water that is removed in the second extended nip $NP_2$ is great and the high pressing force applied in the second extended nip $NP_2$ tends to cause the paper web W to become marked by the fabric comprising the lower felt 36 or by the grooves in the flexible mantle 41 of lower hose roll 40.

Although in FIG. 1, a second extended nip $NP_2$ is shown, alternatively a third roll nip $N_3$ may be used instead of the second extended nip $NP_2$. In this configuration, the press roll 39 is preferably a press roll with a smooth face 39', and a hollow-faced, e.g., grooved, and solid mantle rigid press roll, preferably with a variable crown, takes the place of the lower hose roll 40. The linear load at the third roll nip $N_3$ is preferably from about 70 to about 200 kN/m, most preferably between about 90 and 150 kN/m. and preferably greater than the nip pressure in the second roll nip $N_2$.

Figure 7:
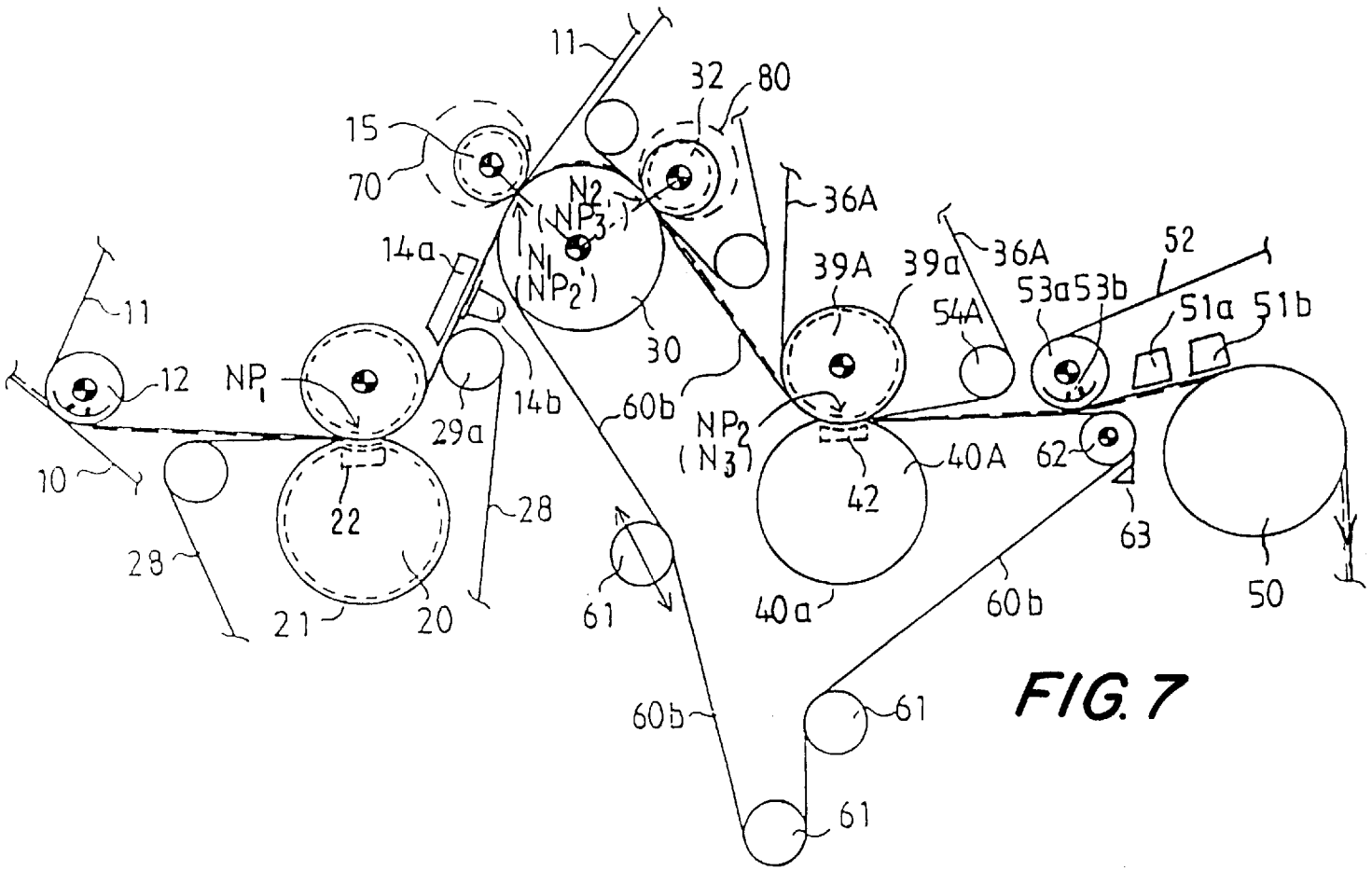
FIG. 7 is a diagrammatic side elevational view of a seventh embodiment of the press section of the present invention.

In a further modification, an upper felt (not shown) may be introduced into the second extended nip $NP_2$ so that the paper web W is sandwiched between the lower felt 36 and this upper felt. Such an upper felt is used to remove additional water directly through the upper surface of the paper web in the second extended nip $NP_2$. If such an upper felt is added, to enhance the dewatering capacity of the second extended nip $NP_2$, the mantle of press roll 39 may be made hollow, as with grooves. The use of an upper felt in the second extended nip $NP_2$ is shown in FIG. 7 which is discussed in detail below.

Downstream of the second extended nip $NP_2$, the lower felt 36 is peeled away from the paper web W by a guide roll 54. The paper web W adheres to the smooth surface 39' of the press roll 39 until it is transferred in a short open draw $W_1$ to a pair of paper guide rolls 53, the lower of which is preferably driven. Means (not shown) known in the art may be included to assist in the transfer of the paper web W. Additionally or alternatively, the paper web W may be initially threaded as known in the art so that it follows the desired path. A drying wire 52 is applied to the upper surface of the paper web W by the upper paper guide roll 53 so that the paper web W, supported on its upper surface by the drying wire 52, passes between the two paper guide rolls 53.

The paper web W is urged to contact and adhere to the lower surface of the drying wire 52 by a pair of suction boxes 51*a* and 51*b* until the paper web W, supported on its upper surface by the drying wire 52, is transferred to the first drying or lead-in drying cylinder 50 of the following dryer section of the paper making machine. The first or lead-in drying cylinder 50 preferably has a diameter $D_{10}$ of about 1,830 mm.

By the time that the paper web W reaches the first drying cylinder 50, the dry solids content of the paper web W has been increased from about 30% to about 75% and preferably about 35% to about 55% as compared with the dry solids content of the paper web W of about 12% to about 20% on its arrival at the first extended nip $NP_1$.

The frames of the press section are conventional frames that permit quick replacements of felts and rolls.

The press section of the present invention is particularly compact so that, for example, in modernizing or rebuilding a paper machine to increase the dewatering capacity of the press section in order to increase the running speed of the paper machine, the press section of the present invention can easily fit into the space occupied by the existing press section of the paper making machine, such as the Sym-Press II® press made by Valmet Corporation. which uses only roll nips.

Figure 2:
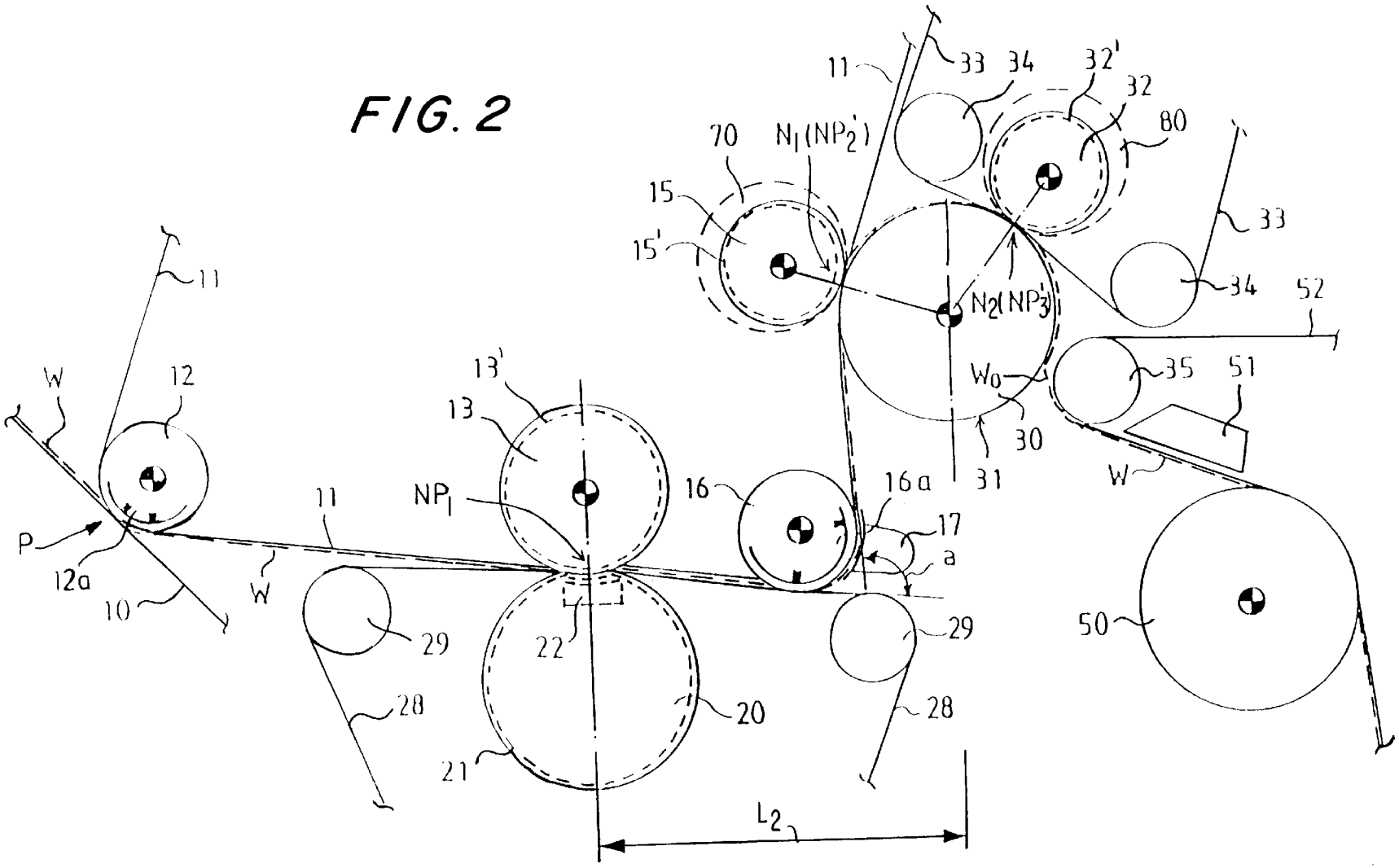
FIG. 2 is a diagrammatic side elevational view of a second embodiment of the press section of the present invention.

In the second embodiment of the present invention shown in FIG. 2, the press section is substantially identical to that in shown in FIG. 1 except that there is only one extended nip (the first extended nip ($NP_1$) rather than two extended nips ($NP_1$ and $NP_2$) as shown in FIG. 1, and an additional suction roller 16 is substituted for the suction box 14*a* immediately after the first extended nip ($NP_1$ to hold the paper web W to the pick-up felt 11 and to separate the paper web W from the lower felt 28. In FIG. 2, the press section is identical to that shown in FIG. 1 through the first extended nip $NP_1$. After the first extended nip $NP_1$, the lower felt 28 and pick-up felt 11 with the paper web W sandwiched in between continue travelling substantially horizontally to a reversing suction roll 16 where the lower felt 28 is transferred to a guide roll 29 and separates from the lower surface of the paper web W and the pick-up felt 11. The paper web W, supported on its upper surface by the pick-up felt 11, travels around a portion of the reversing suction roll 16 after the lower felt 28 has been separated from the lower surface of the paper web W. The reversing suction roll 16, which is preferably driven, has a suction zone 16*a*, the vacuum action of which aids in ensuring that the paper web W separates from the lower felt 28 to travel around the reversing suction roll 16. The reversing suction roll 16 thus performs a function similar to that performed by the suction box 14*a* shown in FIG. 1. Returning to FIG. 2, a steam box 17, or other means to heat the paper web W, is preferably positioned adjacent the exposed unsupported lower surface of the paper web W and substantially opposite to the suction zone 16*a* of the reversing suction roll 16.

The reversing suction roll 16 turns the run of the paper web W and of the upper felt 11 from substantially horizontal to substantially vertical. The change in direction, angle a, of the paper web W and of the upper felt 11 at the reversing suction roll 16 is shown in FIG. 2 as being greater than about 90°, although angle a is preferably only greater than about 45°.

The paper web W and its supporting upper felt 11 then proceed to the center roll 30 and the two roll nips $N_1$, $N_2$, as described in detail with respect to FIG. 1, where pressure is applied to the upper felt 11 and the paper web W by the press roll 15 and the center roll 30 at the first roll nip $N_1$, the upper felt 11 is separated from the paper web W which adheres to the smooth surface of the center roll 30, the press felt 33 is applied to the paper web W, pressure is applied to the press felt 33 and the paper web W by the press roll 32 and the center roll 30 at the second roll nip $N_2$, and the press felt 33 is separated from the paper web W, leaving the paper web W on the surface of the center roll 30. As discussed above with respect to FIG. 1, one or both of press rolls 15, 32 may alternatively be replaced by extended nip hose rolls 70, 80, as shown in dashed lines in FIG. 2. The horizontal distance $L_2$ between the center of hose roll 20 and the center of the center roll 30 is typically from about 2,200 to about 3,600 mm.

The paper web W is then transferred in a short open draw $W_0$ from the smooth surface 31 of the center roll 30 directly to the lower surface of the drying wire 52 which is guided by the paper guide roll 35. Means (not shown) known in the art may be included to assist in the transfer of the paper web W, such as the transfer band loop 60, 60*b* shown in FIGS. 6 and 7 which are discussed in detail below or making guide roll 35 a suction roll. Additionally or alternatively, the paper web W may be initially threaded as known in the art so that it follows the desired path. A suction box 51 ensures that the paper web W adheres to the drying wire 52. The paper web W, supported on its upper surface by the drying wire 52, is transferred to the first drying or lead-in cylinder 50 of the following dryer section of the paper making machine.

Figure 3:
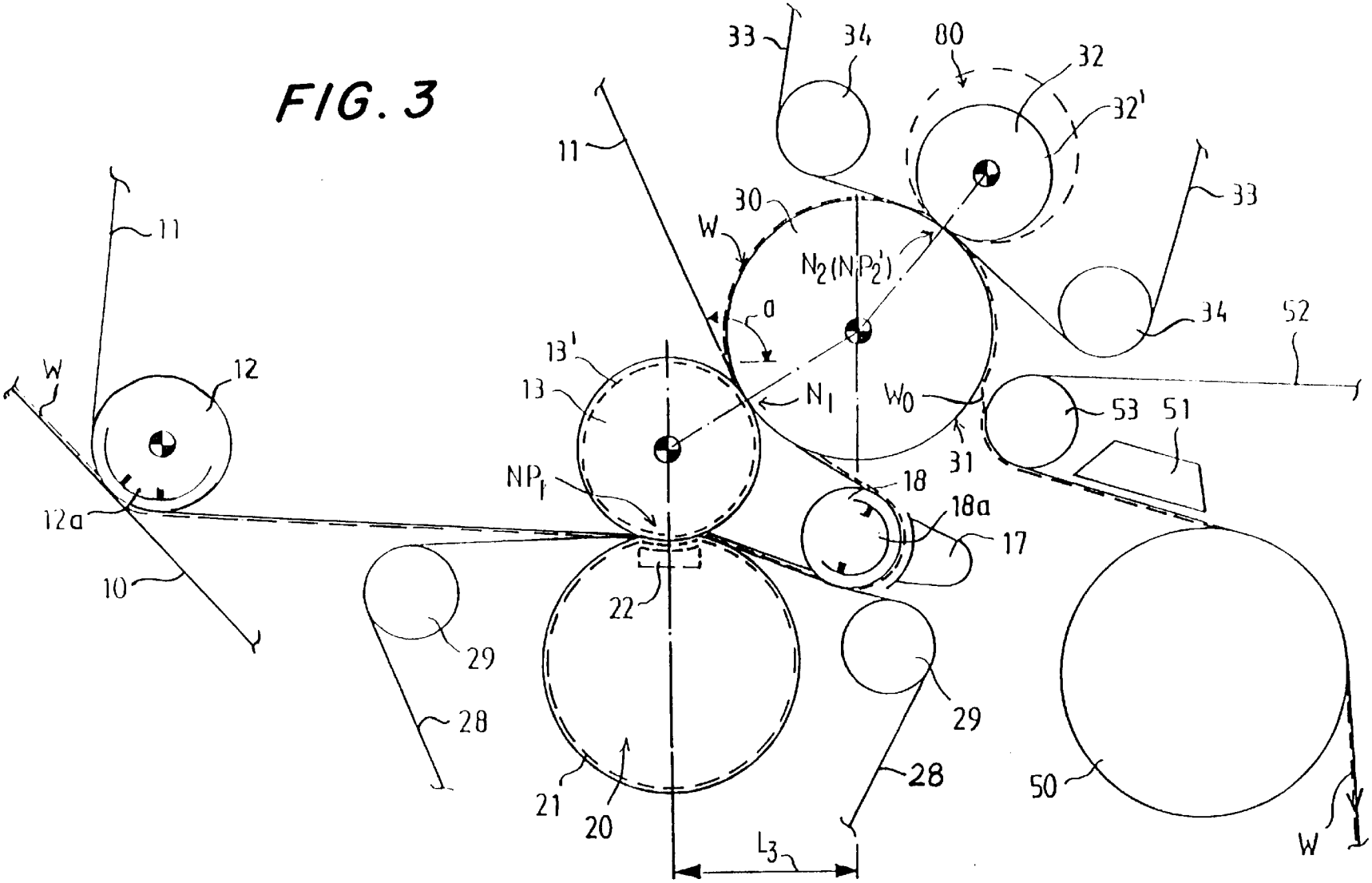
FIG. 3 is a diagrammatic side elevational view of a third embodiment of the press section of the present invention.

In the third embodiment of the present invention shown in FIG. 3, the press section is substantially identical to that in shown in FIG. 2 except that the press roll 13 performs two functions: it is part of the first extended nip $NP_1$ (as discussed with respect to FIG. 1) and it is also part of the first roll nip $N_1$ by substituting for the press roll 15 shown in FIGS. 1 and 2.

In FIG. 3, the press section is identical to that shown in FIGS. 1 and 2 through the first extended nip $NP_1$. After the first extended nip $NP_1$, the lower felt 28 and pick-up felt 11 with the paper web W sandwiched in between continue travelling substantially horizontally to a suction roll 18, which is similar to the reversing suction roll 16 of the embodiment shown in FIG. 2 except that the suction roll 18 is not driven. At suction roll 18, the lower felt 28 is transferred to a guide roll 29 and separates from the lower surface of the paper web W and the pick-up felt 11, and the unsupported exposed lower surface of the paper web W is heated as by the steam box 17. Rather than separating from the suction roll after travelling only about one quarter around the suction roll 18 as shown in FIG. 2, the paper web W and the pick-up felt instead travel about halfway, or about 180°, around the suction roll 18, aided by the vacuum action of the suction zone 18*a* of the suction roll 18, and separate from the suction roll 18 to enter the first roll nip $N_1$ formed by the center roll 30 and the press roll 13. The remainder of the embodiment shown in FIG. 3 is identical to that shown in FIG. 2. By making the press roll 13 a part of both the first extended nip $NP_1$ and the first roll nip $N_1$, the press roll 15 of FIG. 2 is omitted, resulting in a cost saving, and the horizontal length of the press section of FIG. 3 of the present invention is reduced further. Thus, the horizontal distance $L_3$ in the embodiment shown in FIG. 3 between the center of hose roll 20 and the center of the center roll 30 is typically from about 1,200 to about 1,900 mm while the horizontal distance $L_2$ in the embodiment shown in FIG. 2 is typically from about 2,200 to about 3,600 mm. This substantial reduction in length of the press section is possible because the first extended nip $NP_1$ using its two press felts 11, 28 provide substantial dewatering of the paper web W through both surfaces of the paper web W, thereby increasing the dry solids content and the strength of the paper web W, and thereby allowing the direction of travel of the paper web W to be changed substantially, even at relatively high web speeds in the range of about 25 to about 35 m/sec. without damaging the paper web W.

The embodiment of FIG. 3 may be further modified so that the center roll 30 accommodates a third roll nip (not shown) and/or the press roll 32 may be replaced by an extended nip hose roll 80 (shown in dashed lines in FIG. 3), as discussed above with reference to FIGS. 1 and 2.

Figure 4:
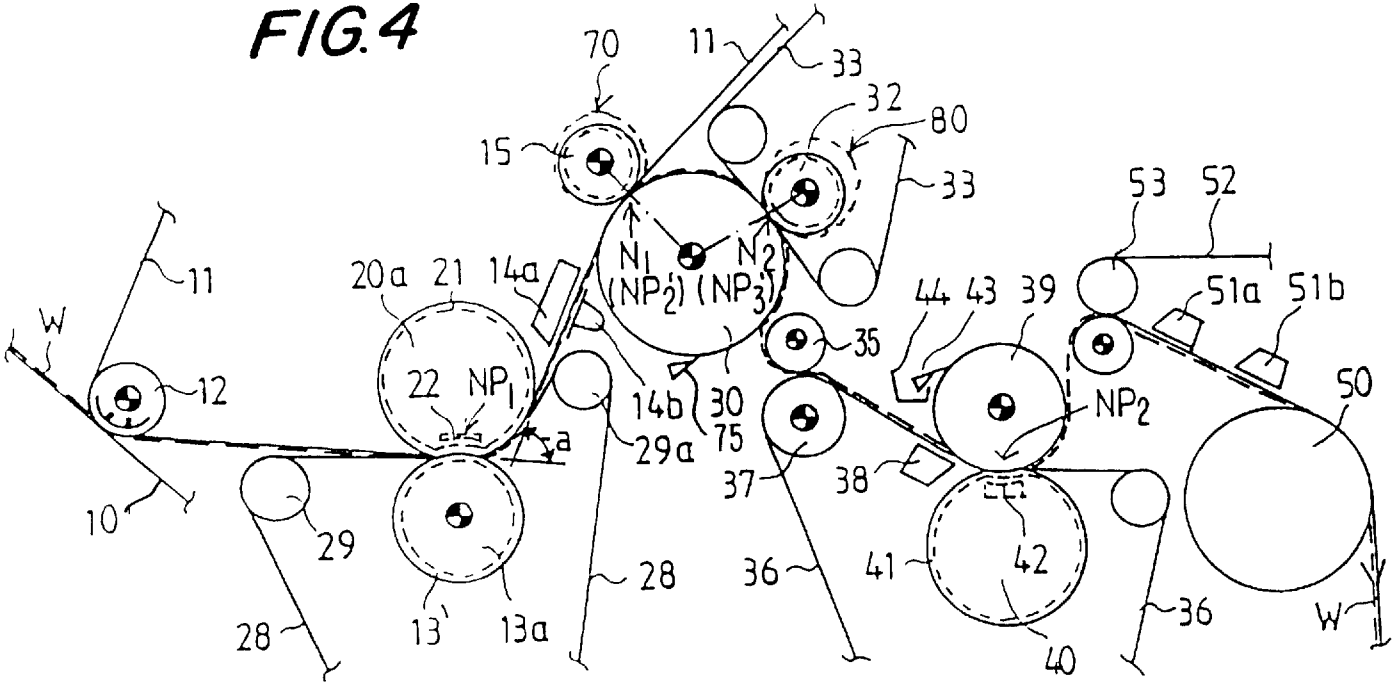
FIG. 4 is a diagrammatic side elevational view of a fourth embodiment of the press section of the present invention.

In the fourth embodiment of the present invention shown in FIG. 4, the press section is substantially identical to that in shown in FIG. 1 except that the positions of the press roll 13 and the hose roll 20 in the first extended nip $NP_1$ are reversed with the press roll 13*a* being in the lower position and the hose roll 20*a* being in the upper position. Additionally, a doctor blade 75 is positioned on the lower portion of the center roll 30 and another doctor blade 43 is positioned on the upper portion of the press roll 39 near the seconded extended nip $NP_2$. These doctor blades 75, 43 are used to remove any portions of the paper web W (i.e., broke) that are not properly transferred from the center roll 30 or the press roll 39, respectively. Broke that is removed from the center roll 30 by the doctor blade 75 can fall down on its own and be removed. However, broke that is removed from the press roll 39 by the doctor blade 43 is falls into and is removed as by a transverse broke trough or conveyor 44 from which it is returned to the pulper of the paper making machine.

As discussed above with respect to FIG. 1, one or both of press rolls 15, 32 may alternatively be replaced by extended nip hose rolls 70, 80, as shown in dashed lines in FIG. 4.

In alternative embodiments of the present invention shown in FIGS. 1, 4, 5 and 7, the positions of the rolls 39, 40, 39A and 49A of the second extended nip $NP_2$ may be reversed as shown in FIG. 4 in the first extended nip $NP_1$ where the press roll 13 is in the lower position and the hose roll 20 is in the upper position.

In the fifth embodiment of the present invention shown in FIG. 5, the press section is substantially identical to that in shown in FIG. 1 except that the press roll 13 with its solid mantle in the first extended nip $NP_1$ has been replaced with an upper suction roll 13*b* with a perforated mantle 13". Additionally, the upper suction roll 13*b* preferably has two successive suction zones 13*c* and 13*d* are disposed in the interior of the perforated mantle 13". The first or upstream suction zone 13*c* is positioned opposite the press shoe 22 of the first extended nip $NP_1$, and the second or downstream suction zone 13*d* is positioned in the sector on which the run of the paper web W and of the upper felt 11 is in substantially a vertical direction, thereby eliminating the need for the suction box 14*a* as shown in FIG. 1. The suction zone 13*c* aids in dewatering the paper web W by drawing water through the pick-up felt 11 and suction zone 13*d* aids in ensuring that the paper web W is separated from the lower felt 28 and changes its direction of travel together with the pick-up felt 11 around the upper roll suction 13*b* after the lower felt 28 has been separated from the paper web W by the guide roller 29*a*, which in this embodiment is not positioned above the first extended nip $NP_1$ but is instead positioned at substantially the same level of the first extended nip $NP_1$ so that the lower felt 28 travels substantially horizontally after passing through the first extended nip $NP_1$.

Because of the high pressing loads that typically exist in the first extended nip $NP_1$ (up to about 1,400 kN/m), the use of the pressing roll 13 with a solid mantle 13' is in many, if not most instances, preferable to a corresponding perforated mantle 13" because such a perforated mantle 13" normally has a load limit of about 150 kN/m. However, a perforated suction roll mantle 13" may be used in applications where very high compression loads in the first extended nip $NP_1$ are not necessary such as in the manufacture of relatively thin paper.

The embodiment shown in FIG. 5 also includes the two doctor blades 75 and 43 and the transverse broke trough or conveyor 44 as shown in and discussed with respect to FIG. 4.

As discussed above with respect to FIG. 1, one or both of press rolls 15, 32 may alternatively be replaced by extended nip hose rolls 70, 80, as shown in dashed lines in FIG. 5.

Figure 6:
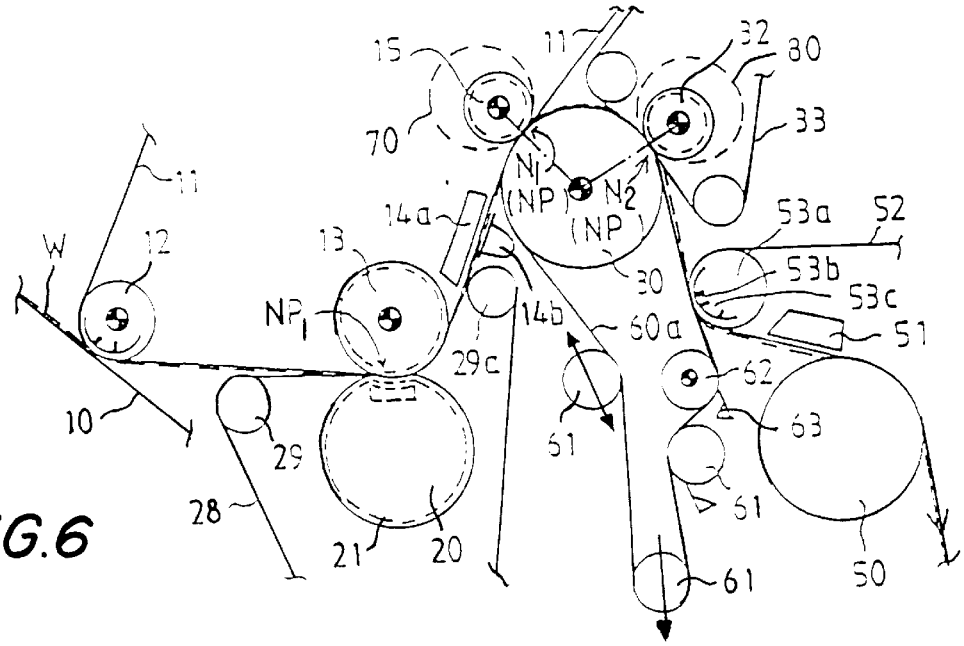
FIG. 6 is a diagrammatic side elevational view of a sixth embodiment of the press section of the present invention.

In the sixth embodiment of the present invention shown in FIG. 6, the press section is substantially identical to that in shown in FIG. 1 except that only one extended nip, the first extended nip $NP_1$, is used and a transfer band loop 60*a* is included to aid in the transfer of the paper web W from the center roll 30 and its two roll nips $N_1$ and $N_2$ to the dryer section of the paper making machine without an open draw.

In FIG. 6, the press section is identical to that shown in FIG. 1 to the first roll nip $N_1$ at which point a transfer band loop 60*a* is applied to the lower surface of the paper web W. At the first roll nip $N_1$, the paper web W is thus sandwiched between the pick-up felt 11 and the transfer band loop 60*a*, and at the second roll nip $N_2$, the paper web is sandwiched between the press felt 33 and the transfer band loop 60*a*. The surface of the transfer band loop 60*a* that contacts the paper web is preferably smooth, and the transfer band loop 60*a* itself is preferably comprised of a materials known in the art, preferably one that is water permeable and may also or instead one that is water absorbing. When the paper web W separates from the smooth surface 31 of the center roller 30, there is no open draw because the paper web W is supported from below by the transfer band loop 60*a*. Downstream of the center roller 30, the transfer band loop 60*a* transfers the paper web W onto the lower surface of the drying wire 52 which is guided by a transfer suction roll 53*a*. The transfer suction roll 53*a* has a pair of suction zones 53*b*, 53*c*, the vacuum action of which aids in ensuring that the paper web W is transferred from the transfer band loop 60*a* to the drying wire 52. The first suction zone 53*b* is proximate the point where the transfer band loop 60*a* separates from the paper web W and the second suction zone is proximate the point where the paper web W is first supported on its upper surface only by the drying wire 52. Downstream of the transfer suction roll 53*a*, a suction box 51 proximate the upper surface of the drying wire 52 is also preferably included to further aid in ensuring that the paper web W adheres to the drying wire 52 until the paper web W and its supporting drying wire 52 arrive at the first drying or lead-in cylinder 50 of the following dryer section of the paper making machine.

As shown in FIG. 6, the transfer band loop 60*a* is guided by three guide rolls 61, the positions of two of which are preferably adjustable (as indicated by the arrows in FIG. 6) to change the tension and alignment of the transfer band loop 60*a*. Another guide roll 62 also guides the transfer band loop 60*a* and is preferably a driven roll. The outer surface of the transfer band loop 60*a* (i.e., the surface that contacts the paper web W) is preferably cleaned by a pair of doctor blades 61 and 63.

As discussed above with respect to FIG. 1, one or both of press rolls 15, 32 may alternatively be replaced by extended nip hose rolls 70, 80, as shown in dashed lines in FIG. 6.

In the seventh embodiment of the present invention shown in FIG. 7, the press section is substantially identical to that in shown in FIG. 6 except that the second extended nip $NP_2$ is also included in the press section and an upper press felt 36A is used in the second extended nip $NP_2$ to further dewater the paper web W. In FIG. 7, the press section is identical to that shown in FIG. 6 through the second roll nip $N_2$ at which point the transfer band loop 60*b* and the paper web W which it supports separate from the center roll 30 and travel in a closed draw to the second extended nip $NP_2$. Means (not shown) known in the art may be included to ensure that the paper web W adheres to the transfer band loop 60*b* as the press felt 33 is separated from the paper web W such as including an appropriately positioned suction roll. Additionally or alternatively, the paper web W may be initially threaded as known in the art so that it follows the desired path. At the second extended nip $NP_2$, an upper press felt 36A is applied to the upper surface of the paper web W so that the paper web is sandwiched between the upper felt 36A and the transfer band loop 60*b*.

The second extended nip $NP_2$ is formed by a press roll 39A, which is preferably driven, and a lower hose roll 40A. The lower hose roll 40 has a flexible smooth mantle 40*a* and a press or loading shoe 42. The press shoe 42 is loaded by hydraulic cylinders (not shown) to adjust the level and distribution of the compression pressure applied by the press shoe 42 and the flexible mantle 40*a* to the transfer band loop 60*b* and the paper web W in the second extended nip $NP_2$, both in the direction of progress or advance of the paper web W and in a direction transverse to the direction of progress the paper web W. The press roll 39A is preferably hollow-faced 39*a*, such as grooved, blind-drilled, or provided with other recesses.

Downstream of the second extended nip $NP_2$, the upper felt 36A is separated from the paper web W and travels around guide roller 54A to return to the second extended nip $NP_2$ after being at least partially dried. Means (not shown) known in the art may be included to ensure that the paper web W adheres to the transfer band loop 60*b* as the upper felt 36A is separated from the paper web W such as including an appropriately positioned suction roll. Additionally or alternatively, the paper web W may be initially threaded as known in the art so that it follows the desired path. The transfer band loop 60*b* travels in a substantially horizontal run to a transfer suction roll 53*a* where the paper web W contacts the lower surface of the drying wire 52 which is guided by a transfer suction roll 53*a*, which in this embodiment is preferably a driven roller. The transfer suction roll 53*a* has a suction zone 53*b*, the vacuum action of which aids in ensuring that the paper web W is transferred from the transfer band loop 60*b* to the drying wire 52. The suction zone 53*b* is proximate the point where the drying wire 52 contacts the paper web W. The transfer suction roll 53*a* thus separates the transfer band loop 60*b* from the lower surface of the paper web W. It is thereafter guided around driven guide roll 62 and the three guide rolls 61. A pair of suction boxes 51*a* and 51*b* are preferably located proximate the upper surface of the drying wire 52 to further aid in ensuring that the paper web W adheres to the drying wire 52 until the paper web W and its supporting drying wire 52 arrive at the first drying or lead-in cylinder 50 of the following dryer section of the paper making machine.

Although the embodiment shown in FIG. 7 employs a second extended nip $NP_2$, the second extended nip $NP_2$ can instead be a roll nip $N_3$. Also, as discussed above with respect to FIG. 1, one or both of press rolls 15, 32 may alternatively be replaced by extended nip hose rolls 70, 80, as shown in dashed lines in FIG. 7.

Figure 8:
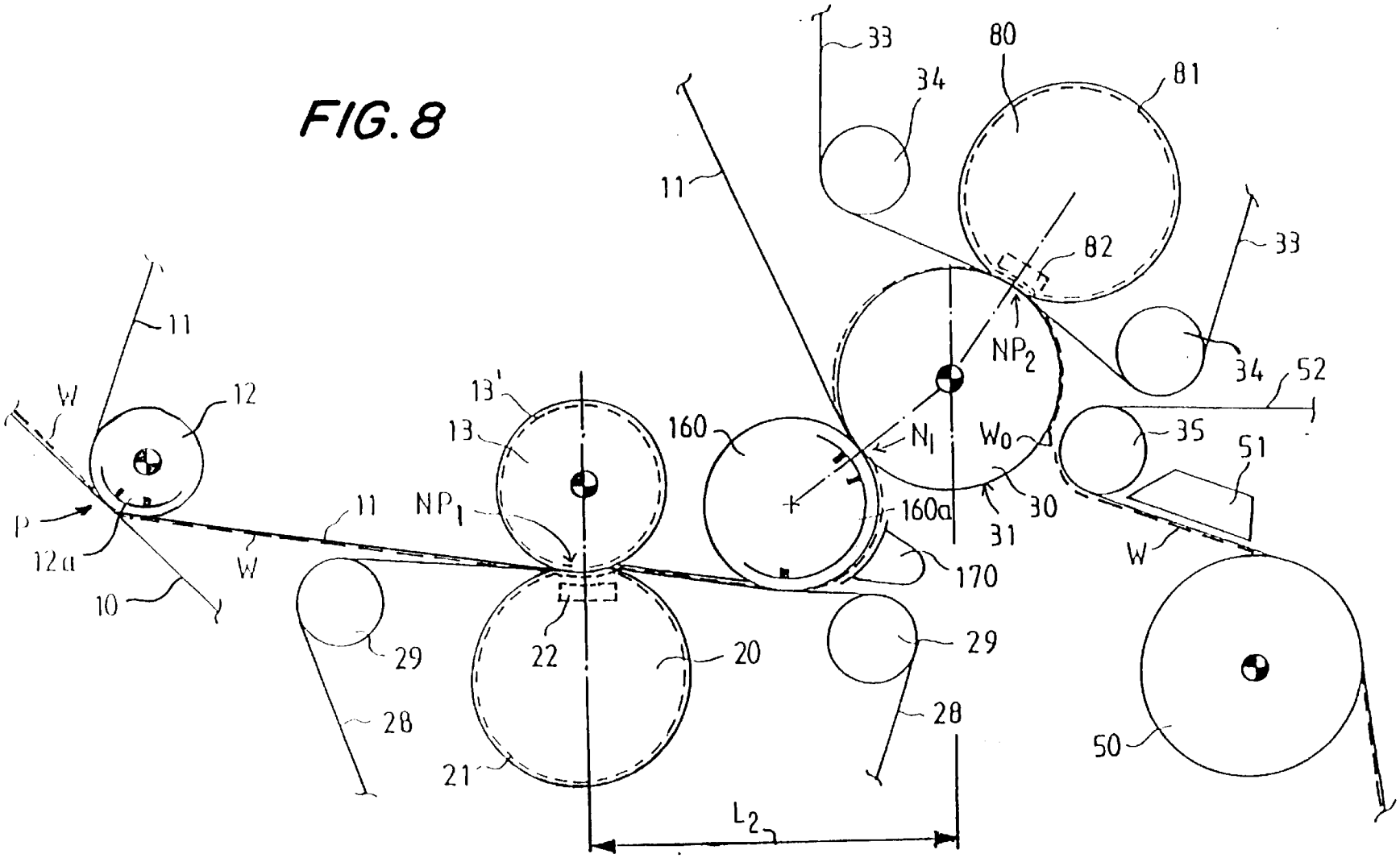
FIG. 8 is a diagrammatic side elevational view of an eighth embodiment of the press section of the present invention.

The eighth embodiment of the present invention shown in FIG. 8 is similar to that shown in FIG. 2 in that suction roller 16 and press roll 15 are combined into a single reversing suction roll 160. The reversing suction roll 160, which is preferably driven, has a suction zone 160*a*, the vacuum action of which aids in ensuring that the paper web W separates from the lower felt 28 to travel around the reversing suction roll 160. A steam box 170, or other means to heat the paper web W, is preferably positioned adjacent the exposed unsupported lower surface of the paper web and substantially opposite to the suction zone 160*a* of the reversing suction roll 160. The reversing suction roll 160 turns the run of the paper web W and of the upper felt 11 to enter a nip $N_1$ formed between the reversing suction roll 160 and the center roll 30. An extended nip $NP_2$ is formed on the center roll 30 by a hose roll 80 which has a press shoe 82 and preferably a flexible mantle 81.

Figure 9:
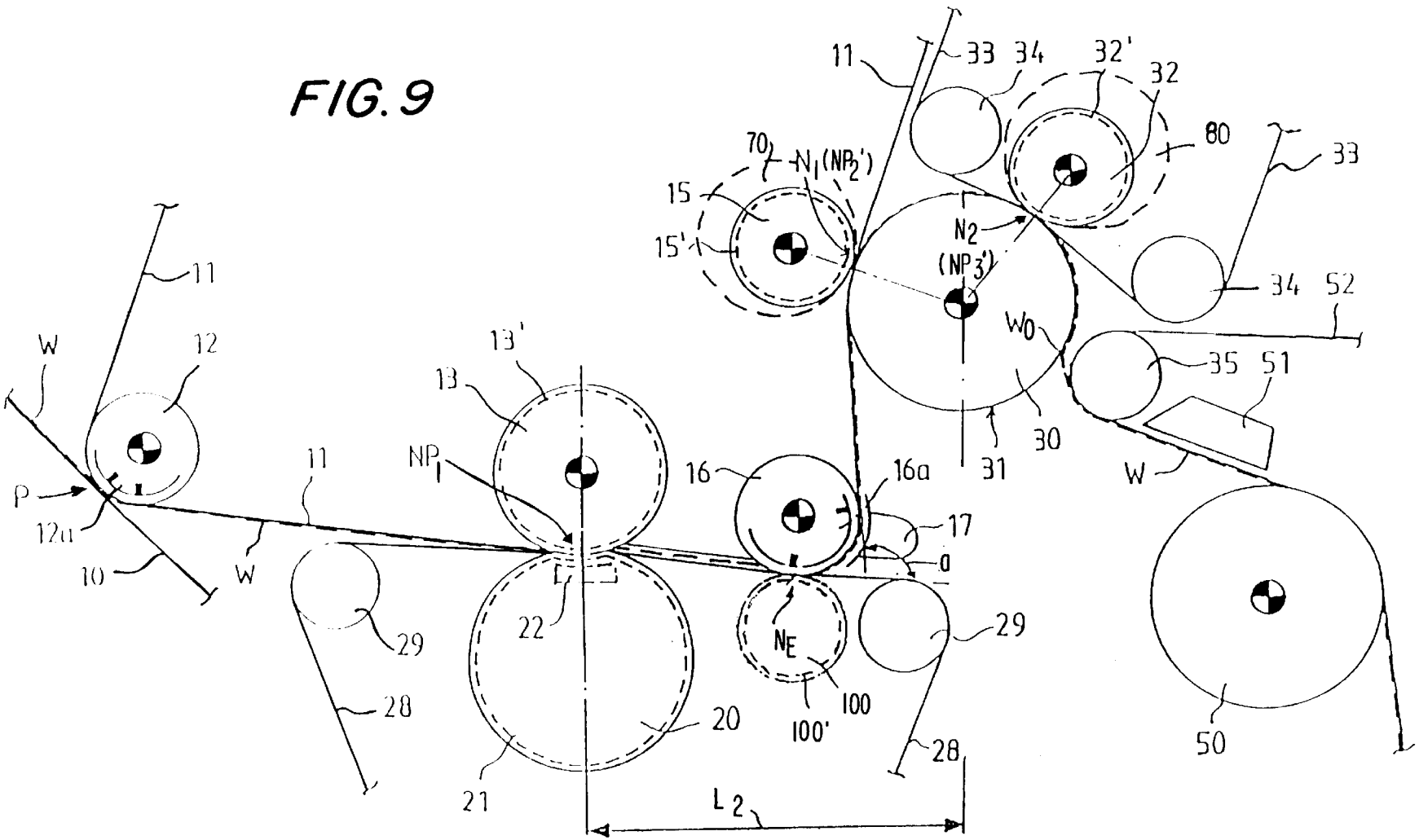
FIG. 9 is a diagrammatic side elevational view of an ninth embodiment of the press section of the present invention.

The ninth embodiment of the present invention shown in FIG. 9 is substantially identical to that shown in FIG. 2 except that an additional press roll 100, which preferably has a flexible mantle 100', is positioned to contact the lower felt 28 between the press roll 20 and the guide roll 29 and adjacent suction roller 16 to form a nip $N_E$. In this nip $N_E$, which is formed on the suction roller 16, the paper web W is further pressed between the pick-up felt 11 and the lower felt 28.

Figure 10:
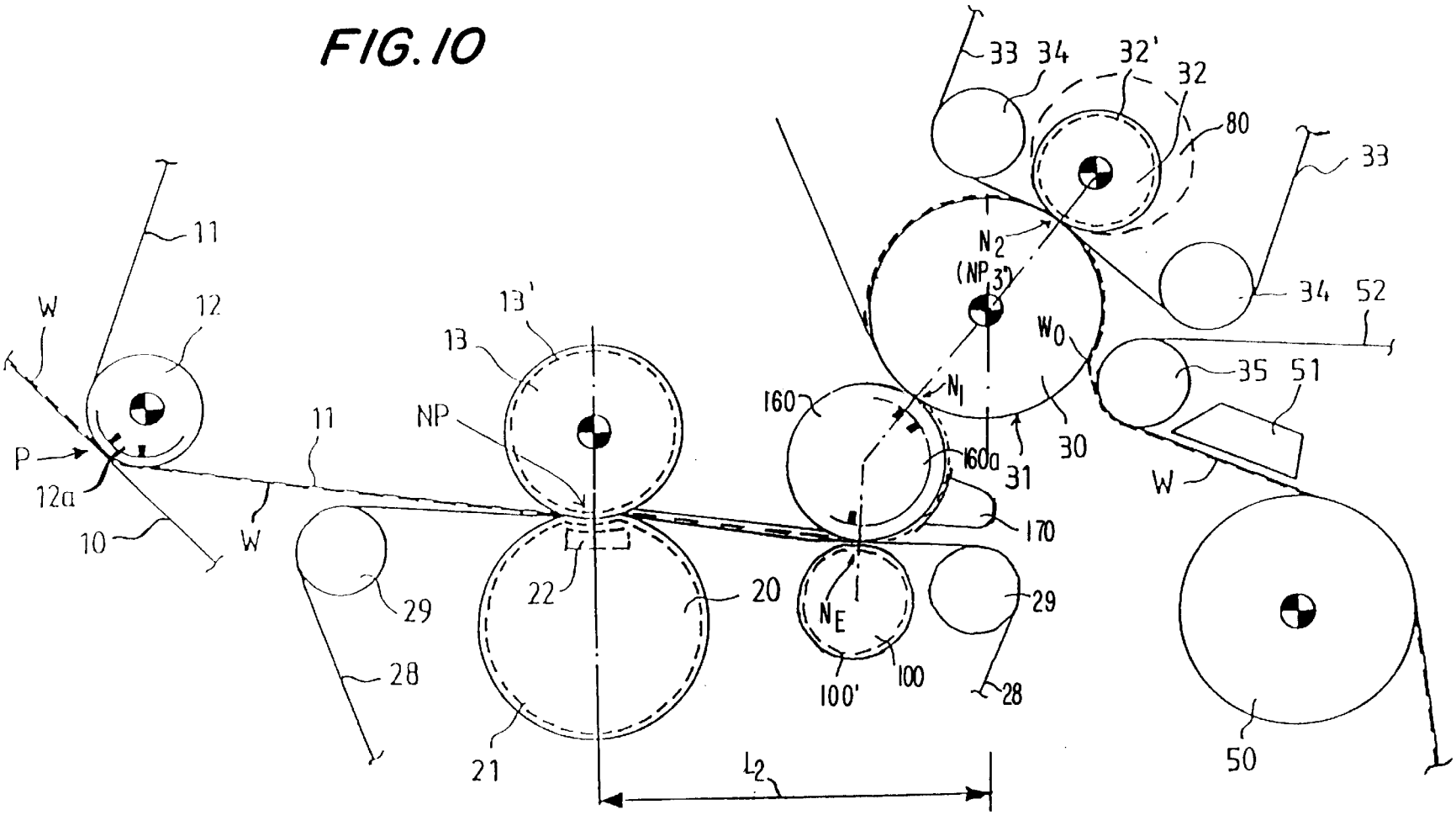
FIG. 10 is a diagrammatic side elevational view of an tenth embodiment of the press section of the present invention.

The tenth embodiment of the present invention shown in FIG. 10 is substantially identical to that shown in FIG. 8 except that an additional press roll 100, which preferably has a flexible mantle 100', is positioned to contact the lower felt 28 between the press roll 20 and the guide roll 29 and adjacent suction roller 16 to form a nip $N_E$. In this nip $N_E$, which is formed on the suction roller 16, the paper web W is further pressed between the pick-up felt 11 and the lower felt 28. In addition, a press roll 32 is shown forming a press nip $N_2$ on the center roll 30, rather than en extended nip $NP_2$ as shown in FIG. 8.

Figure 11:
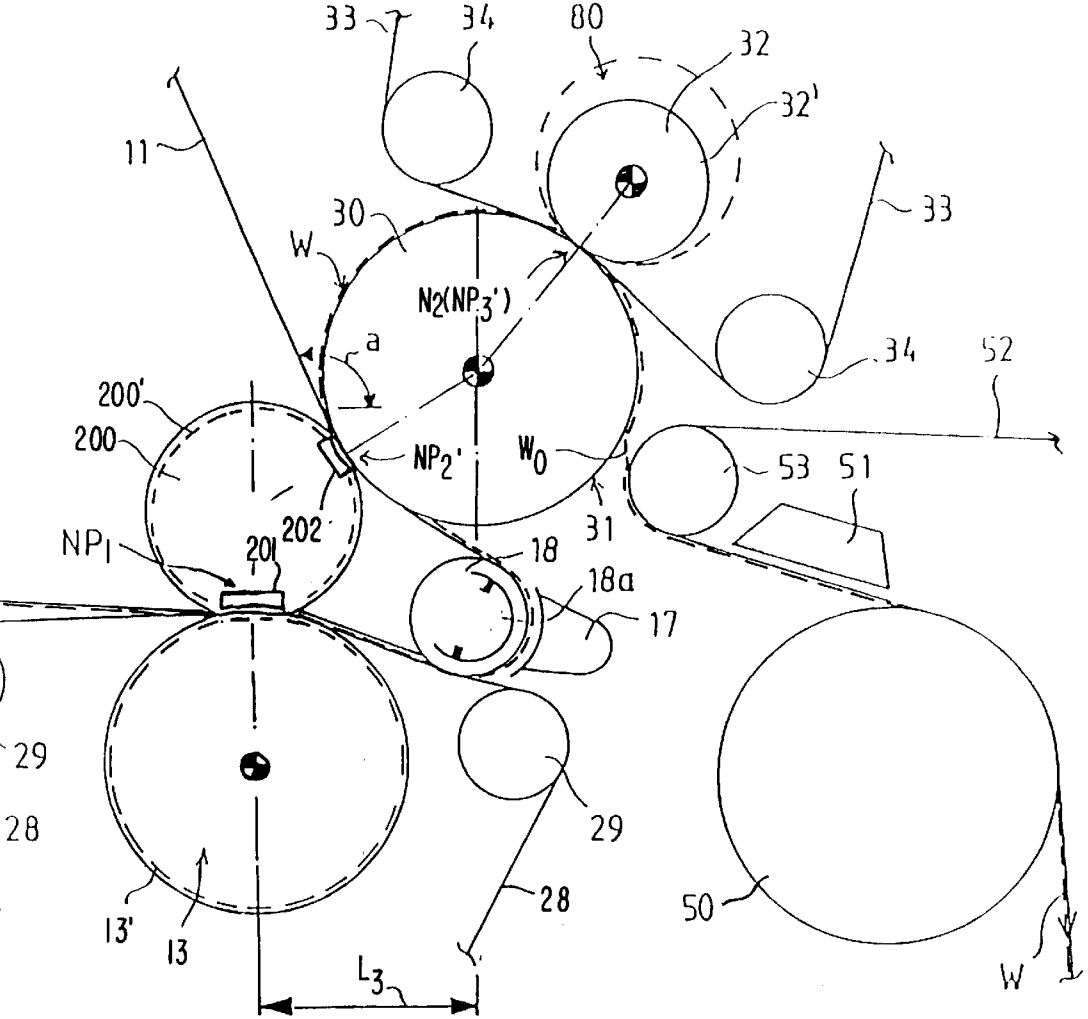
FIG. 11 is a diagrammatic side elevational view of an eleventh embodiment of the press section of the present invention.

The eleventh embodiment of the present invention shown in FIG. 11 is substantially identical to that shown in FIG. 3 except that in FIG. 11 an upper hose roll 200, with a flexible mantle 200', forms the first extended nip $NP_1$ using a press shoe 201 also forms another, second extended nip $NP_2$' on the center roll 30 using a press shoe 202.

Figure 12:
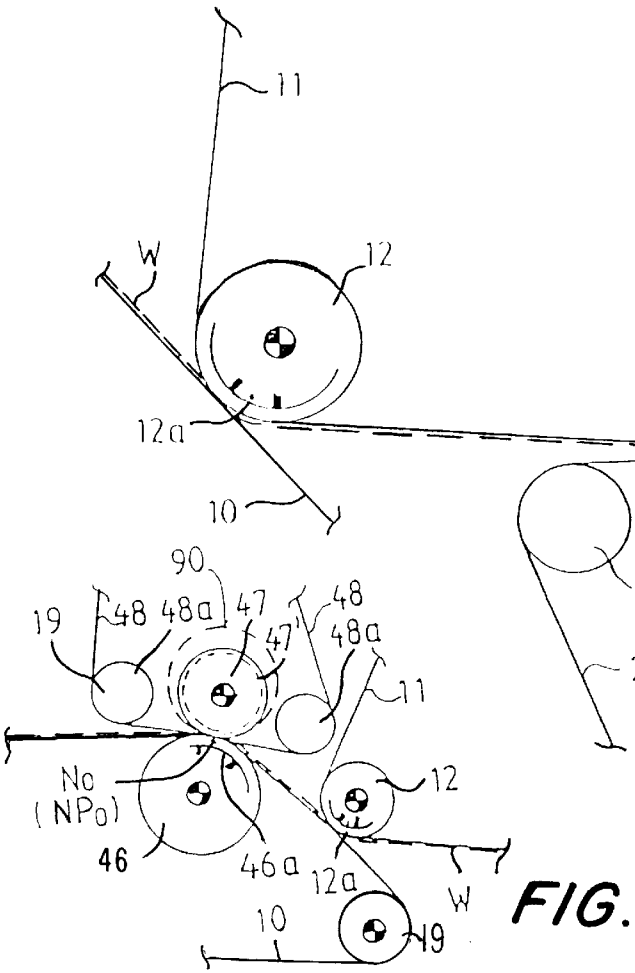
FIG. 12 is a diagrammatic side elevational view of an alternative embodiment of the initial portion of the press section of in FIGS. 1 to 11.

In FIG. 12 is shown an alternative embodiment of the initial portion of the press section shown in FIGS. 1 to 11 where the paper web W enters the press section after being formed in the forming section of the paper machine. In this embodiment, a roll nip $N_0$ and a primary press felt 48 are used before the paper web W is removed from the forming wire 10 of the forming section to reduce the water content of the paper web W, increase the strength of the paper web W before it enters the press section of the paper making machine, and therefore increase the running speed of the paper making machine as a whole where the speed of the press section is the speed limiting factor.

The primary press felt 48 is applied to the paper web W supported forming wire 10 so that the paper web W is sandwiched between the primary press felt 48 and the forming wire 10. Because at this point in the paper making process the paper web W has a high water content, the press felt 18 is a relatively water permeable and open fabric that also absorbs water. The primary press felt 48, the paper web W and the forming wire 10 pass to a primary press nip $N_0$ which is comprised of a suction roll 46 and an upper press roll 47 which has a hollow face 47'. Both the suction roll 46 and the upper press roll 47 are preferably driven rolls. The primary press felt 48 is guided into the primary press nip $N_0$ by a wire drive roll 19. Downstream of the primary press nip $N_0$, the press felt is separated from the upper surface of the paper web W by guide roll 48*a* from which it travels back to the wire drive roll 19 after being at least partially dried.

The suction roll 46 has a suction zone 46*a* which is positioned proximate the primary press nip $N_0$. The vacuum action of the suction zone 46*a* aids in ensuring that the paper web W adheres to the forming wire 10 as the press felt is peeled away from the paper web W by guide roll 48*a* and also aids in the removal of water expressed through the forming wire.

As shown in and described with respect to FIG. 1, the paper web W is then removed from the forming wire 10 by the pick-up suction roll 12 with its suction zone 12*a*.

Because the paper web W has relatively low strength at when it reaches the primary press nip $N_0$, it is preferable to apply a relatively low linear load to the paper web W in the primary press nip $N_0$ so that the structure of the paper web W is not damaged or crushed. The primary press nip $N_0$, which typically raises the dry solids content of the paper web W from about 12% to about 18%, may also be an extended nip $NP_0$, as suggested in Finnish patent application No. 905798 (published), corresponding to U.S. patent application Ser. Nos. 07/795,043 and 08/026,851, all three of which were previously incorporated herein by reference. In this embodiment, upper press roll 47 is replaced by an extended nip hose roll 90 shown in dashed lines in FIG. 12. This hose roll 90 is similar to hose roll 20 discussed above with reference to FIG. 1.

The primary press nip $N_0$ can be used in any press section embodying the present invention; however, its preferred use is in paper making machines which manufacture paperboard or other paper that is thicker than average, in paper making machines employing pulp grades which are relatively difficult to dewater, or in paper making machines where the desired paper web running speed is very high.

Although various preferred roll diameters and horizontal distances between various rolls have been disclosed, these horizontal distances are influenced by, among other things, the width of the paper making machine: as the width of the paper making machine increases, the roll diameters also become larger. The disclosed dimensions are thus merely typical and may be varied to meet both space and operational requirements without departing from the present invention. Likewise, the choice of which rolls are driven (indicated in the Figures by a hub divided into four quadrants) and which roll are not has been described pursuant to present preference; however, modifications of these selections are possible and are within the skill of the person of ordinary skill in the art.

It should further be noted that numerous adjunct devices not directly forming a part of the present invention have been omitted from the foregoing description as their inclusion is well within the ability of a person of ordinary skill. Among such omitted devices are broke conveyors, save-alls to collect water, and particular roller drives.

Thus, while there have been shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Substitutions of elements from one described embodiment to another are also fully intended and contemplated. It is also to be understood that the drawings are not necessarily drawn to scale but that they are merely conceptual in nature. It is the intention, therefore, to be limited only as indicated by the scope of the claims appended hereto.

What is claimed is:

1. A method for dewatering a paper web formed in a forming section of a paper making machine comprising:

applying a first felt to a first surface of a paper web formed in a forming section of a paper making machine, the first felt being comprised of a material that is at least one of water absorbing and water permeable;

applying a second felt to a second surface of the web, the second felt being comprised of a material that is at least one of water absorbing and water permeable;

transporting the web, sandwiched between the first and second felts, to a first extended nip;

pressing the web, sandwiched between the first and second felts, in the first extended nip to at least partially dewater the web by applying pressure to a portion of a length of the web and across a width of the web, a linear load being applied to the web in the first extended nip being less than about 150 kN/m over a distance of from about 100 mm to about 300 mm, the first extended nip being formed by a press roll in an upper position and a hose roll in a lower position, the press roll having a rigid, perforated mantle with a hollow-face and a suction zone disposed within the perforated mantle applying suction to the first felt as the first felt and the web partially wrap around the press roll, the hose roll having a flexible mantle and a press shoe within the flexible mantle proximate the press roll, the press shoe applying pressure to a portion of a length of the web;

separating the second felt from the web downstream of the first extended nip by wrapping the first felt partially around the press roll, by the suction zone of the press roll applying suction to the first felt and to first surface of the web, and by guiding the second felt along a path different than a path travelled by the first felt;

after separating the second felt from the web, applying the second surface of the web to a center roll having a smooth surface by supporting the web with the first felt against the center roll;

pressing the web against the center roll with a first pressure roll in a first pressure nip by passing the first felt and the web through the first pressure nip to at least partially dewater the web by applying pressure to the first felt and the web across the width of the web;

separating the first felt from the first surface of the web downstream of the first pressure nip by directing the first felt away from the center roll while allowing the web to remain in contact with the center roll;

after separating the first felt from the web, applying a third felt to the first surface of the web as the web remains in contact with the center roll; and pressing the web against the center roll in a second pressure nip by passing the third felt and the web through the second pressure nip to at least partially dewater the web by applying pressure to the third felt and the web with a second pressure roll across the width of the web.

2. The method of claim 1, wherein in the first pressure nip the first pressure roll is a hose roll having a flexible mantle and a press shoe within the flexible mantle proximate the center roll and the press shoe applies pressure to a portion of a length of the web.

3. The method of claim 1, wherein in the first pressure nip the web is pressed in a roll nip.

4. The method of claim 1, wherein in the second pressure nip the second pressure roll is a hose roll having a flexible mantle and a press shoe within the flexible mantle proximate the center roll and the press shoe applies pressure to a portion of a length of the web.

5. The method of claim 1, wherein in the second pressure nip the web is pressed in a roll nip.

6. The method of claim 1, further comprising:

separating the third felt from the first surface of the web downstream of the second pressure nip by directing the third felt away from the center roll;

removing the web from the center roll after the third felt has been separated from the web;

after removing the web from the center roll, applying a band to the second surface of the web;

transporting the web supported by the band to a second extended nip; and pressing the web and the band in the second extended nip to at least partially dewater the web by applying pressure to a portion of a length of the web and across a width of the web.

7. The method of claim 6, wherein in the second extended nip, a linear load applied to the web is from about 150 kN/m to about 1400 kN/m over a distance of from about 100 mm to about 300 mm.

* * * * *